US007506656B2

(12) United States Patent
Cerruti

(10) Patent No.: US 7,506,656 B2
(45) Date of Patent: Mar. 24, 2009

(54) DISPENSER OF WASHING AGENTS FOR A HOUSEHOLD WASHING MACHINE, IN PARTICULAR A DISHWASHER

(75) Inventor: Daniele Cerruti, Fontanetto Po (IT)

(73) Assignee: Eltek S.p.A., Casale Monferrato (Alessandria) (IT)

( * ) Notice: Subject to any disclaimer, the term of this patent is extended or adjusted under 35 U.S.C. 154(b) by 808 days.

(21) Appl. No.: 10/498,994

(22) PCT Filed: Dec. 13, 2002

(86) PCT No.: PCT/IB02/05343

§ 371 (c)(1),
(2), (4) Date: Jun. 18, 2004

(87) PCT Pub. No.: WO03/053213

PCT Pub. Date: Jul. 3, 2003

(65) Prior Publication Data

US 2005/0103365 A1 May 19, 2005

(30) Foreign Application Priority Data

Dec. 21, 2001 (IT) ..... TO2001A1207

(51) Int. Cl.
*B08B 3/08* (2006.01)

(52) U.S. Cl. ..... 134/99.2; 134/25.2; 134/56 D; 134/57 D; 134/58 D; 134/93; 220/817; 220/818; 220/835; 222/129; 222/153.02; 222/173; 222/511; 222/515; 222/517

(58) Field of Classification Search ..... 134/25.2, 134/56 D, 57 D, 58 D, 99.2, 93; 220/817, 220/818, 835; 222/129, 153.02, 173, 511, 222/515, 517
See application file for complete search history.

(56) References Cited

U.S. PATENT DOCUMENTS 5,076,641 A * 12/1991 Lindberg ..... 297/188.19

FOREIGN PATENT DOCUMENTS

| | | | |
|---|---|---|---|
| DE | 198 43 976 A | | 4/1999 |
| DE | 19843976 A1 | * | 4/1999 |
| DE | 100 14 146 A | | 9/2001 |
| WO | WO 0197674 A2 | * | 12/2001 |

OTHER PUBLICATIONS

STIC Translation: English Translation of DE 19843976 A1.*

* cited by examiner

*Primary Examiner*—Frankie L Stinson
*Assistant Examiner*—Samuel A Waldbaum
(74) *Attorney, Agent, or Firm*—Sughrue Mion, PLLC

(57) ABSTRACT

A dispenser of washing agents for a household washing machine, in particular a dish-washer, comprises a body (2), at least one compartment (6) for containing a washing agent, and a lid (7), which may be tipped over or turned about a first axis of rotation (8) between a position of closing and a respective first position of at least partial opening of the compartment (6), so as to enable delivery of the washing agent. According to the invention, there are envisaged articulation means (4), which are interconnected between the body (2) and the lid (7) and are operative for enabling the latter to turn about a second axis of rotation (5) between said closing position and a respective second position of at least partial opening of the compartment (6) so as to enable charging in the latter of the washing agent to be delivered.

36 Claims, 9 Drawing Sheets

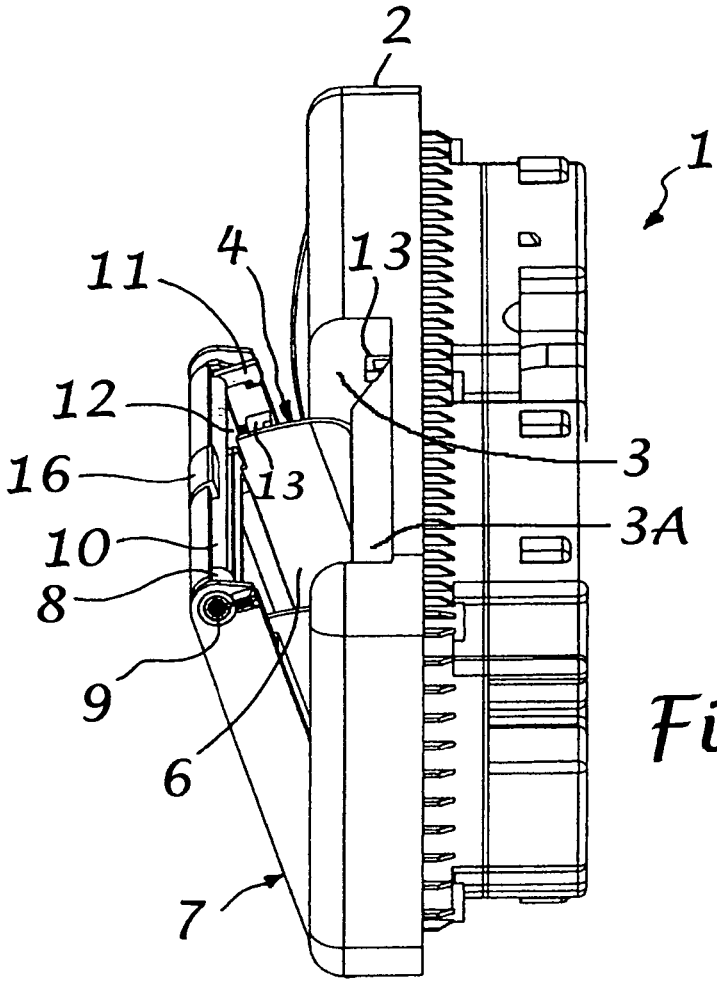
Fig. 3
Fig. 5
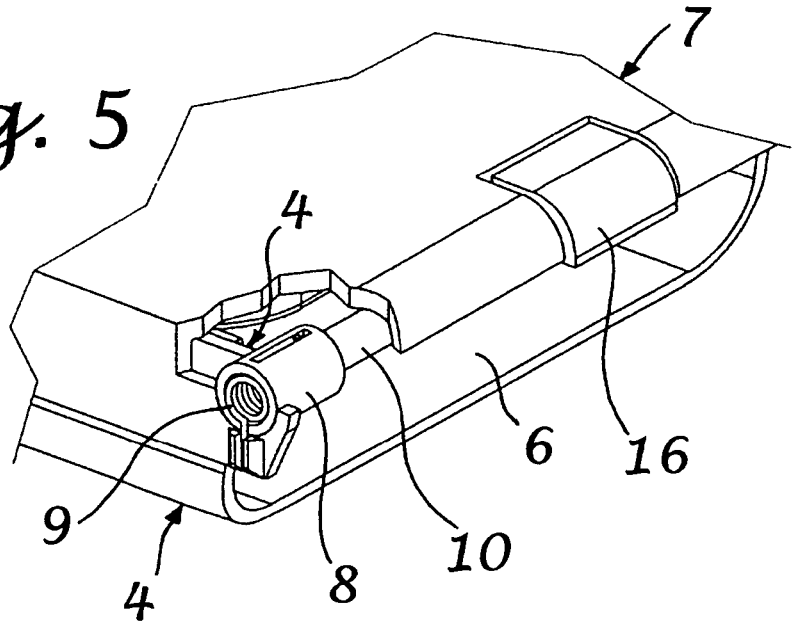

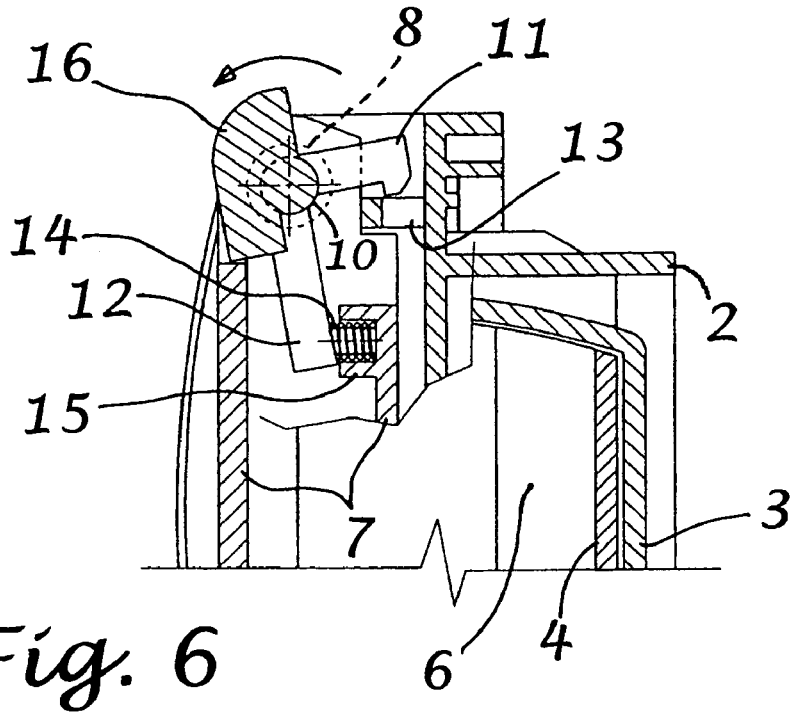
Fig. 6
Fig. 7
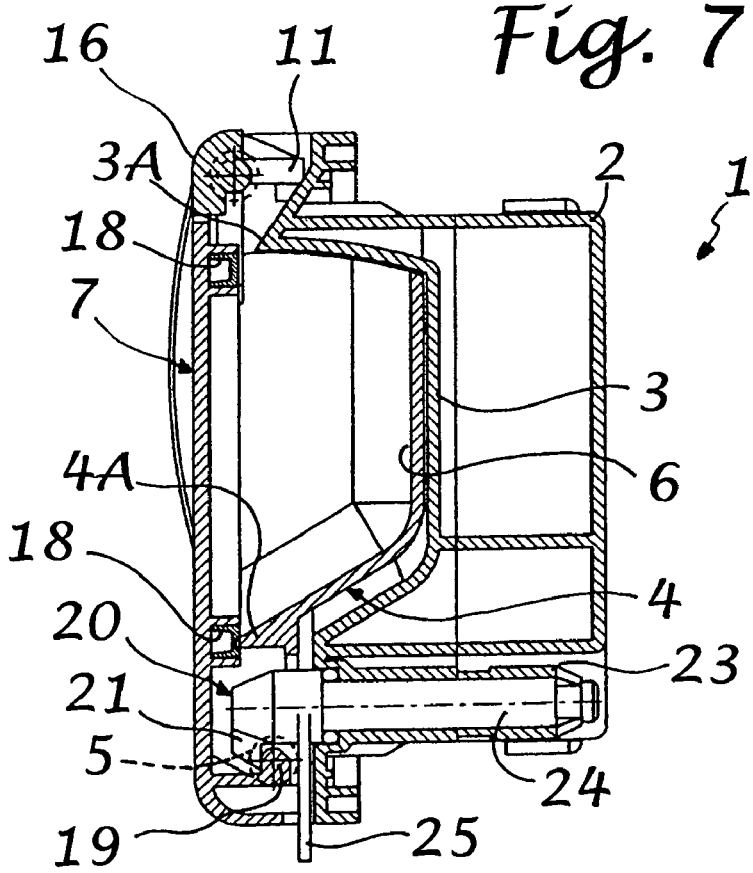

DISPENSER OF WASHING AGENTS FOR A HOUSEHOLD WASHING MACHINE, IN PARTICULAR A DISHWASHER

FIELD OF THE INVENTION

The present invention relates to a dispenser of washing agents for a household washing machine, in particular a dish-washer.

DESCRIPTION OF THE RELATED ART

Dispensers of washing agents of the type referred to usually comprise a body made of plastic material which is designed to be fixed to and/or set partially into the side of the door of the dish-washer so that the front part or area of the body itself is set facing the inside of the washing chamber of the machine.

In the aforesaid front area of the body of the dispenser, there is defined a compartment or cup for containing a given amount of detergent, usually in the form of powder or in the form of tablets, which is necessary for execution of a washing cycle. The space is equipped with a respective lid, which is usually hinged by means of pins to the body of the dispenser.

In the majority of cases, the door of the dish-washer is angularly mobile about a horizontal axis, i.e., it can be tipped or turned over between a closed position, in which the door is in a vertical position, and a position for loading the machine with dishes, in which the door is in a horizontal position. The majority of dispensers are generally configured so that the opening of the cup faces upwards when the door of the machine is in a substantially horizontal position. It is only with the cup in this condition that the user is able to introduce a dose of washing agent into the cup, close the corresponding lid of the dispenser, and then close the door of the machine. Opening of the lid at the appropriate moment of the washing cycle is controlled by a programmer, or timer, of the dish-washer so as to bring about dropping of the detergent into the washing chamber both by gravity and as a result of the splashing of liquid coming from the members that spray water inside the dish-washer.

In other known types of dish-washers, the door for loading the machine is not angularly mobile but rather slides linearly on guides (see, for instance, FR-A-2674426). Also in these cases, the dispenser of washing agents is fixed to the door of the machine or at any rate to a wall or vertical surface delimiting the washing chamber. The dispenser must therefore be designed to operate always on one and the same plane of lie, which is independent of the condition of opening or closing of the door. This entails a fabrication of the dispenser that is somewhat different as compared to what has been described previously with reference to dish-washers that are equipped with doors that turn over.

From the German document DE-A-19843976, there is known a dispenser in which the lid itself of the cup for the detergent has a charging passage, in a position corresponding to which there is mounted a small auxiliary lid, the latter being directly hinged to the main lid.

According to this embodiment, when both the main lid and the auxiliary lid are in their respective closing positions, the cup is completely closed. With the main lid in the closed position, the auxiliary lid can be opened manually for convenient charging of the detergent in the corresponding compartment. The auxiliary lid can then be closed, again manually, before proceeding to closing the door of the dish-washer and to starting up the washing cycle. In the course of the said cycle, the programmer or timer of the machine will control opening of the main lid, with the consequent delivery of the detergent in a way similar to what was described previously. The solution referred to in the prior document mentioned above enables facilitation of charging of the detergent in the case of machines with doors that turn over, since this form of charging can be carried out with the door itself almost in a vertical position. The same technical solution could moreover be adopted in the case of machines equipped with doors that slide linearly.

OBJECTS AND SUMMARY OF THE INVENTION

Starting from the prior art, the purpose of the present invention is to provide a new dispenser of washing agents for a washing machine which is simple to produce, convenient to use, ensures reliable operation, and has a contained cost, and where, in particular, proper charging and/or dosing of the detergent may be performed in a convenient and easy manner for the user, both in the case where the dispenser is fixed on sliding doors or on constantly vertical surfaces and in the case where the dispenser is fixed on doors that turn over.

One or more of the above-mentioned purposes are achieved, according to the present invention by a device for dispensing washing agents for a household washing machine, in particular a dish-washer, having the characteristics specified in the attached claims, which are to be understood as forming an integral part of the present description.

BRIEF DESCRIPTION OF THE DRAWINGS

Further purposes, characteristics and advantages of the present invention will emerge clearly from the ensuing detailed description and from the annexed drawings, which are provided purely by way of explanatory and non-limiting example and in which:

FIGS. 2 and 3 are perspective views, taken at different angles from one another and with respect to FIG. 1, of a dispenser of washing agents made in accordance with the present invention in a second operating condition;

FIG. 5 is a perspective view of a part of the dispenser of washing agents shown in the previous figures;

FIG. 6 is a vertical schematic section of a part of the dispenser of washing agents shown in the previous figures, during a step of release of a respective lid;

FIG. 7 is a cross section taken along the line VII-VII of FIG. 1;

DETAILED DESCRIPTION OF PREFERRED EMBODIMENTS OF THE INVENTION

In the attached figures, the reference number 1 designates, as a whole, a dispenser of washing agents built according to the present invention, designed for use on a washing machine (not represented), which here is assumed as being a dish-washer.

The dispenser 1 has a main body 2, preferably designed for being housed at least in part in an opening provided on the inner side of the door of the dish-washer, it being possible for the said door to be indifferently of the type that turns over or of the sliding type. The aforesaid opening for at least partial setting-in of the body 2 may likewise be defined in a vertical wall of the washing chamber of the dish-washer. Consequently, in general terms, the body 2 can be fixed to any surface delimiting the washing chamber of the dish-washer, in particular a surface of one of its vertical walls, in the position of lie visible in FIG. 3 and FIGS. 7 to 9. In line with the known art, the body 2 may be obtained by welding of a front piece and a rear piece made of thermoplastic material.

It is to be noted that, in the ensuing description, terms such as "top", "bottom", "front", "rear", etc. are to be understood as referring to the position that the dispenser 1 occupies when it is mounted on a vertical surface, i.e., in the typical operating condition viewed from inside the washing chamber of a dish-washer with the door closed.

In the body 2, there is defined a tank (not visible in the figures) for containing a liquid washing agent or brightening agent. The letter T designates the cap of, an opening, in communication with the aforesaid tank, the said opening being used for charging the container with the brightening agent. Designated by AS is an opening for discharging, through which a dose of said brightening agent can be made to flow towards the washing chamber of the dish-washer. Designated by SP is a warning light indicating the level of the brightening agent present inside the corresponding tank. The procedure for producing, and the mode of operation of, the tank for the brightening agent, as well as the corresponding dosage and delivery system, will not be described in detail herein since they do not regard the purposes of the present description and can be according to any known technique.

In the front part of the body 2, there is likewise defined a housing, designated by 3 in the Figures, which defines a seat or central depression designed to accommodate at least one portion of an intermediate articulation element, designated as a whole by 4. In the embodiment of the invention represented by way of example in the attached figures, the intermediate element 4 fulfils functions of containment of the detergent, as will emerge clearly from what follows.

Figure 4:
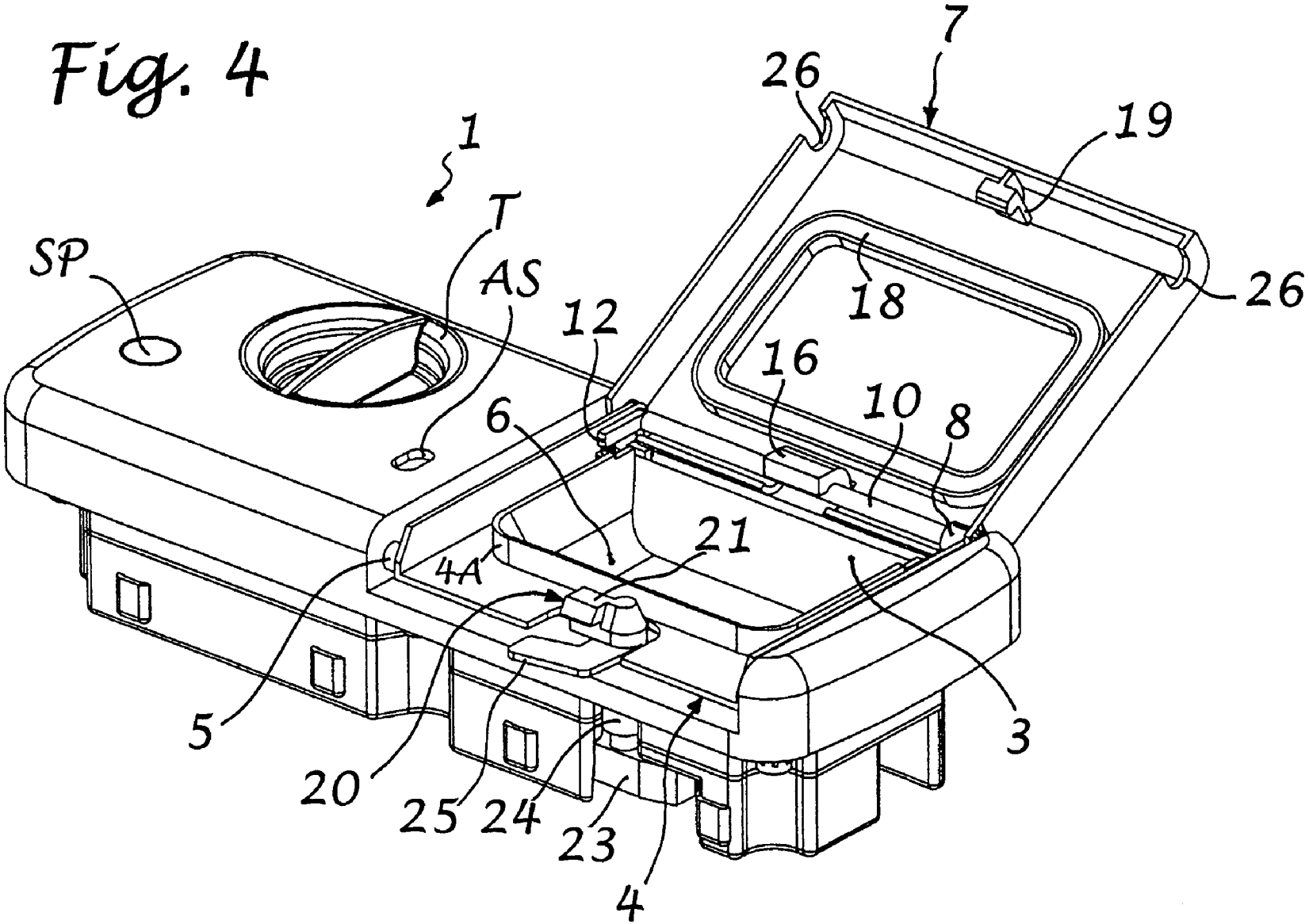
FIG. 4 is a perspective view, taken at an angle similar to that of FIG. 1, of a dispenser of washing agents made in accordance with the present invention in a third operating condition.

In the non-limiting example provided in FIGS. 1 to 9, the intermediate element 4 is hinged, substantially at its bottom end, to the body 2 by means of two lateral pins, one of which is designated by 5 in FIG. 4, the said pins being of known construction. The pins 5 may be integral with the body 2 and partially inserted into respective holes present in the intermediate element 4 or, instead, be replaced by hinging elements that are technically equivalent.

In the case provided herein by way of example, in the intermediate portion of the element 4, there is defined a compartment or tray 6, which is open towards the front part of the dispenser 1 (see again FIG. 4), the said compartment 6 being designed to receive a given dose of detergent necessary for carrying out a washing cycle. For the purposes of the ensuing description, it is assumed that the said detergent is in powder form, but it should be borne in mind that the invention may be applied also in the case of detergents in the form of tablets, gel, foam, liquid, etc.

Figure 2:
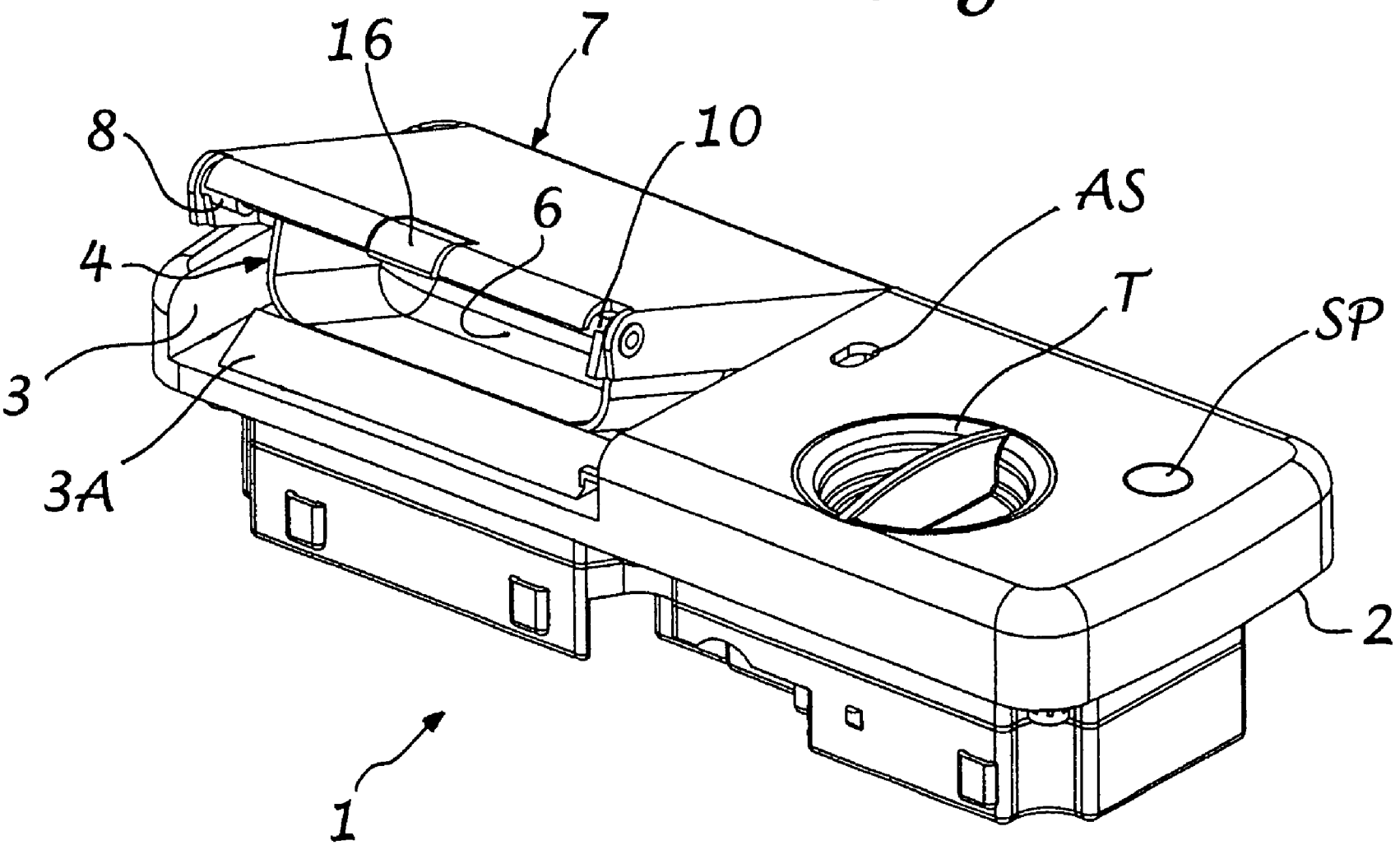

As may be noted from FIGS. 2 and 3, the compartment 6 is open also at the top part of the element 4, i.e., in the longitudinal end opposite to the one in which the pins 5 are provided.

The number 7 designates, as a whole, a lid or lid that can be turned over, provided for closing at least partially both the housing 3 and the compartment 6. According to an important feature of the present invention, the lid 7 is hinged, or in any case constrained, to the intermediate element of articulation 4, and the latter, as has been said, is, in turn, hinged, or in any case constrained in its movement, to the body 2.

In the example illustrated in FIGS. 1 to 9, the lid 7 is substantially constrained at the top longitudinal end of the articulation element 4, i.e., the end opposite to the one in which the pins 5 are provided.

In the proximity of its top end, in each side of the element 4, there is defined a tubular seat 8, only one of which is visible by way of example in FIGS. 2 to 5, the said tubular seat 8 extending in a respective through hole present on the homologous side of the lid 7. In this way, the lid 7 is able to perform angular movements with respect to the element 4. Of course, the seats 8 could form part of the lid 7 and be inserted in holes present in the element 4. In one of the seats 8 (see, in particular, FIG. 5), there is housed a spring 9, which reacts between the element 4 and the lid 7, in the sense that it exerts a load on the latter so that it will assume a respective first opening position for delivery of the detergent, as illustrated, for example, in FIG. 4.

In the two seats 8, there are inserted the ends of one and the same shaft 10, which is able to perform angular movements.

As may be noted, in particular in FIGS. 3 and 6, in the vicinity of the point of insertion into the seat 8 opposite to the one containing the spring 9, there are integral, with the shaft 10, a top arm 11 and a bottom arm 12, which are substantially orthogonal to one another. At the free end of the top arm 11, which extends substantially in a horizontal direction, there is defined a tooth, designed to engage selectively a respective engagement seat designated by 13, which is integral with the body 2 of the dispenser. The free end of the bottom arm 12, which extends substantially in a vertical direction, is designed to co-operate with a spiral spring 14, which is inserted in a corresponding housing 15 defined in the intermediate element 4.

Finally, in the median area of the shaft 10, there is fixed or set integrally an actuating element or push-button 16, set in a position corresponding to a respective passage defined in the lid 7, in such a way as to be directly accessible to a user both from the top part and from the front part of the lid 7.

As will emerge clearly from what follows, the shaft 10, the arms 11, 12, the seat 13 and the spring 14, together with the push-button 16, make up a system for manual clamping/release of the assembly consisting of the lid 7 and the articulation element 4 with respect to the body 2 of the dispenser.

Designated by 18 in FIG. 4 and FIGS. 7 to 9 is a gasket, inserted in a respective housing defined on the inner surface of the lid 7. In the case of the example, and, as may be noted in FIG. 7, the gasket 18 is designed to operate so as to form a seal on one lip 4A of the element 4, which delimits the compartment 6 along three sides, remaining, instead, at a distance from the end of a chute portion 3A (see also FIGS. 2 and 3) of the top part of the housing 3, said portion 3A having the function of facilitating charging of the detergent into the compartment 6. In the embodiment provided by way of example, the presence of the gasket 18 enables, in the condition of the lid 7 being closed, isolation of the inside of the compartment 6 just along three sides with respect to the outside. Such an arrangement may be provided to enable a certain amount of water to enter the compartment 6 during the initial steps of a washing cycle carried out in the dish-washer, and again in conditions of closing of the lid 7, in order to bring about a partial dissolution of the detergent contained therein prior to its supply to the washing chamber.

Figure 10:
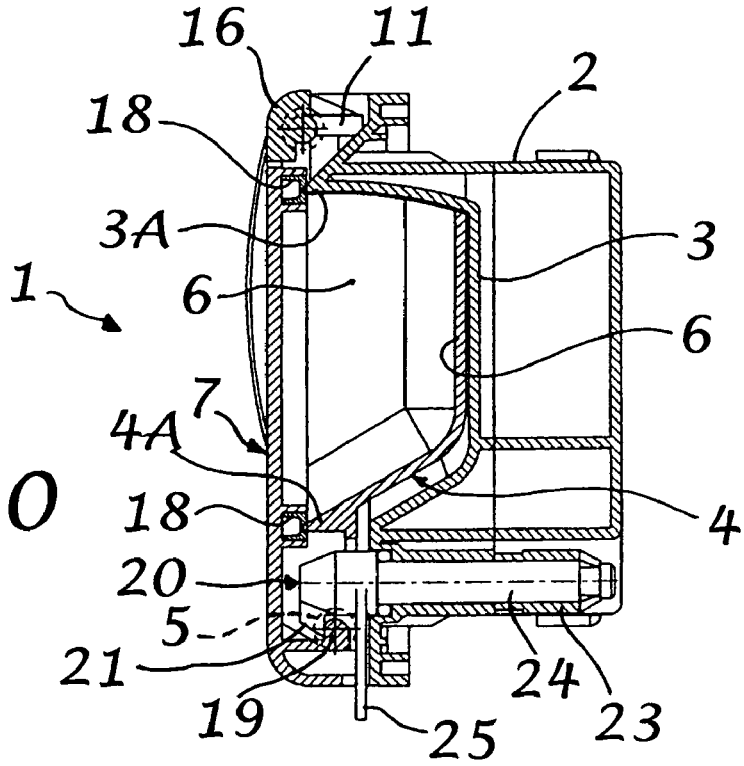
FIG. 10 is a cross section similar to the one illustrated in FIG. 7 of a dispenser made according to a first possible variant of the invention.

It is moreover to be noted that, in a possible variant embodiment illustrated in FIG. 10, the end of the chute portion 3A could be longer or, in any case, envisaged in such a way as to come into contact with the gasket 18 so that, in the condition of the lid 7 being closed, the inside of the compartment 6 will be completely isolated from the outside.

The reference number 19 designates a tooth, defined at the end of a projection, which branches off from the inner surface of the lid 7 in the bottom area of the latter. The tooth 19 is designed to co-operate with an engagement lever designated, as a whole, by 20, which is associated to the body 2 so that it will be able to perform an angular movement, the said lever 20 being designed in a manner known in the field.

The lever 20 has an engagement portion 21, which defines an inclined plane, on which the tooth 19 is able to slide during closing of the lid 7 with respect to the lever.

The surface of the tooth 19 is shaped so as to enable or facilitate the movement of opening of the intermediate element 4, enabling its rotation with respect to said engagement portion 21, as will emerge more clearly from what follows. As may be noted, in particular from FIG. 9, in the case provided by way of example, the surface of the tooth 19 is rounded instead of forming an inclined plane with sharp edge, as is typically the case of dispensers of a known type.

The dispenser 1 is equipped, in its rear part, with actuator means of a type in themselves known and hence not shown in detail in the attached drawings. The said actuator means are provided for producing, by means of a known mechanism, actuation of the lever 20 in order to obtain opening of the lid 7. The aforesaid actuating means are activated by the programmer or timer of the dish-washer in the course of the washing cycle at the moment in which supply of the detergent contained in the compartment 6 is to be provided, as will emerge clearly from the ensuing description.

As in the prior art, the arrangement is such that activation of the aforesaid actuator means brings about movement of a transmission element, which can be seen in part in FIG. 4 and FIGS. 7 to 9 and is designated by 23, in order to bring about angular movement of a respective shaft inserted in a passage that traverses the body 2. At one end of said shaft, designated by 24 in FIG. 4 and FIGS. 7 to 9, there is fixed the lever 20 in such a way that, with the angular movement of the shaft, there is a corresponding identical angular movement of the lever 20.

In the case provided by way of example in the figures, there is also fixed to the lever 20 or to the shaft 24 an arm 25, which projects with respect to the overall dimensions of the body 2. The said arm 25 is provided for enabling manual opening of the lid 7, if so required.

The use of the dispenser 1 according to the invention is according to the procedure described in what follows.

Assuming that the dispenser 1 is mounted on a door of a sliding type of a dish-washer or, more in general, on any vertical surface designed to delimit the washing chamber of the dish-washer itself, the position of lie of the body 2 is always the one that can be seen, for example, in FIG. 3 and FIGS. 7 to 9.

Figure 9:
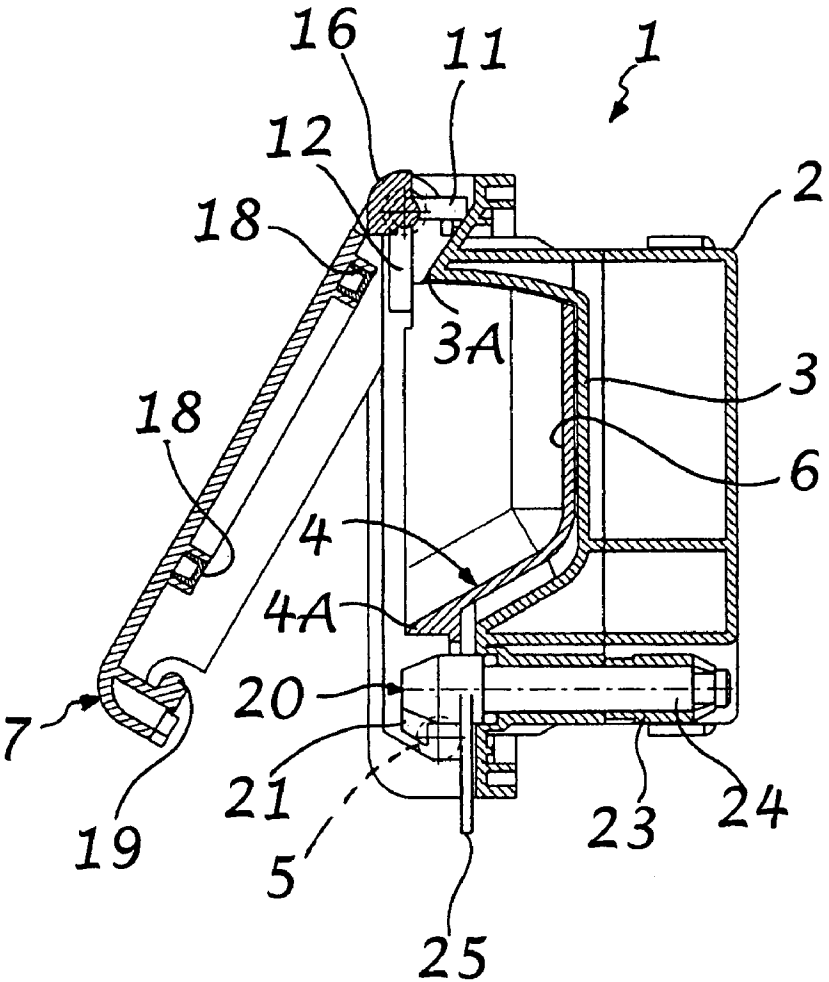
FIG. 9 is a cross section similar to the one illustrated in FIG. 7, but with the dispenser during passage from its first operating condition, shown in FIG. 1, to its third operating condition, shown in FIG. 4.

At the end of a washing cycle of the dish-washer, the dispenser is typically in the condition of the lid 7 being open, as illustrated in FIG. 9 or, more precisely, in FIG. 4 (in FIG. 9, the lid 7 is at the start of its opening movement; the complete angular movement of the lid, during delivery of the detergent is approximately through 120°—see FIG. 4).

Note that, in any case, the condition of opening of FIG. 9 could correspond to a condition of maximum opening of the lid 7 during delivery of the detergent, for instance, in the case where the aim is to limit the overall operating dimensions of the dispenser, in order to recover space for a rack for containing the dishes inside the washing chamber of the machine.

After loading the dishes into the dish-washer, the user brings about complete manual closing of the lid 7 by pressing the lid towards the body 2. In this way the surface of the tooth 19 of the lid 7 presses against the inclined surface of the portion 21, bringing about an angular movement in a clockwise direction of the lever 20 until the end of the inclined surface exceeds the tooth 19. The shaft 24, and consequently the lever 20, are loaded by elastic means (not represented, since they are in themselves known) so as to move in a counterclockwise direction and return into their respective initial positions, thus obtaining reciprocal engagement between the tooth 19 and the portion 21.

It should be noted that, in the embodiment provided by way of example in the Figures, attainment of the above position is enabled by virtue of the presence of two lateral undercuts in the lid 7, designated by 26 in FIG. 4. As may be appreciated, when the lid 7 is in the position illustrated in FIGS. 1 or 2, respective portions of the pins 5 are set within the aforementioned undercuts 26.

Figure 1:
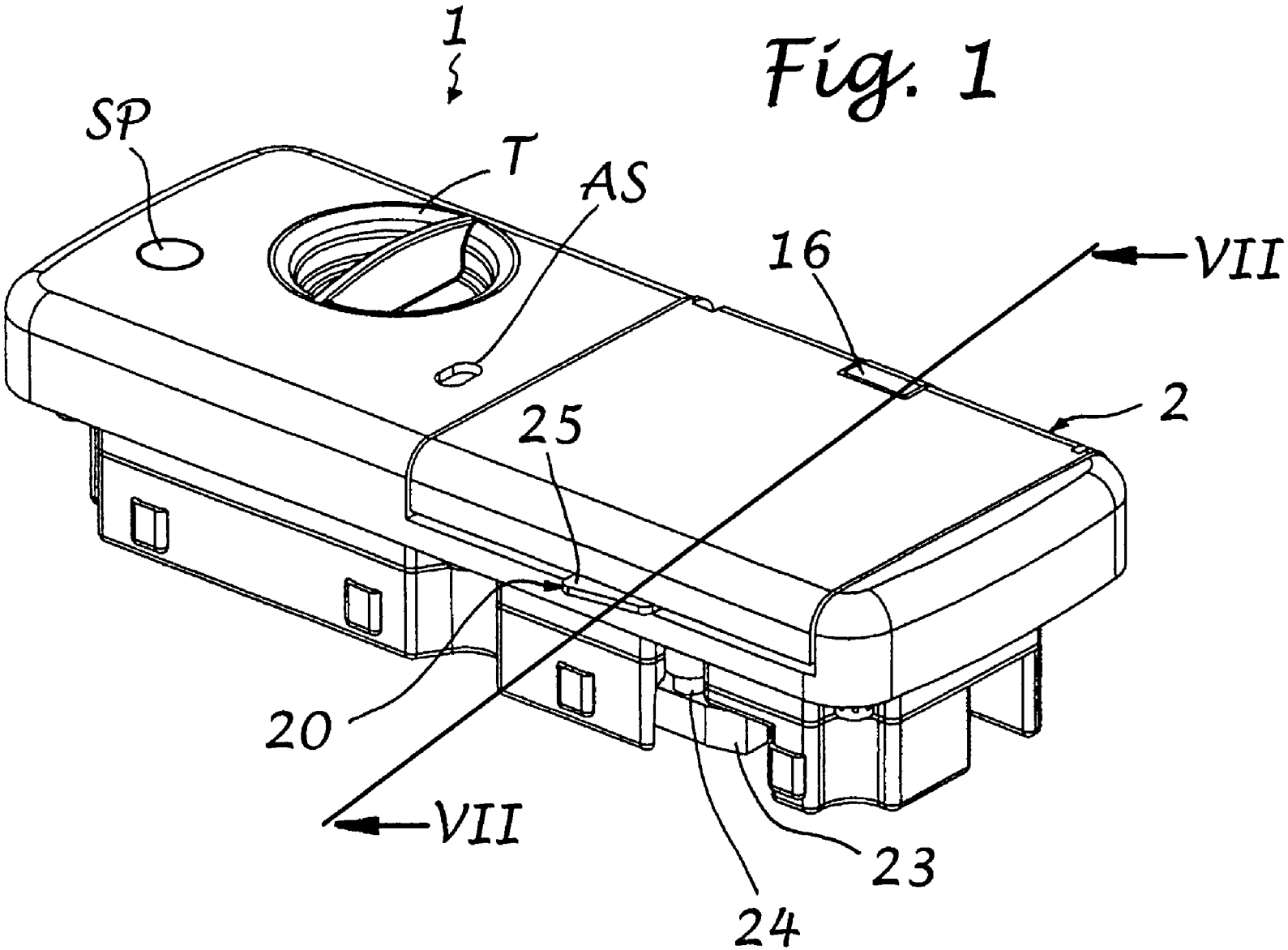
FIG. 1 is a perspective view of a dispenser of washing agents built according to the present invention in a first operating condition.

In this condition, therefore, the lid 7 is completely closed, as may be seen in FIGS. 1 and 7.

In order to charge the detergent, the user must press the button 16. As may be appreciated from FIG. 6, the said pressure on the button 16 will bring about an angular movement of the shaft 10 and consequently of the top arm 11, countering the elastic reaction of the spring 14 with respect to the bottom arm 12. The end tooth of the arm 11 is thus released from the respective engagement seat 13, thus bringing about release of the assembly made up of the lid 7 and the articulation element 4 with respect to the body 2. Of course, once the manual action on the button 16 is terminated, the button returns, along with the shaft 10, to its original position by means of the action of the spring 14.

Figure 8:
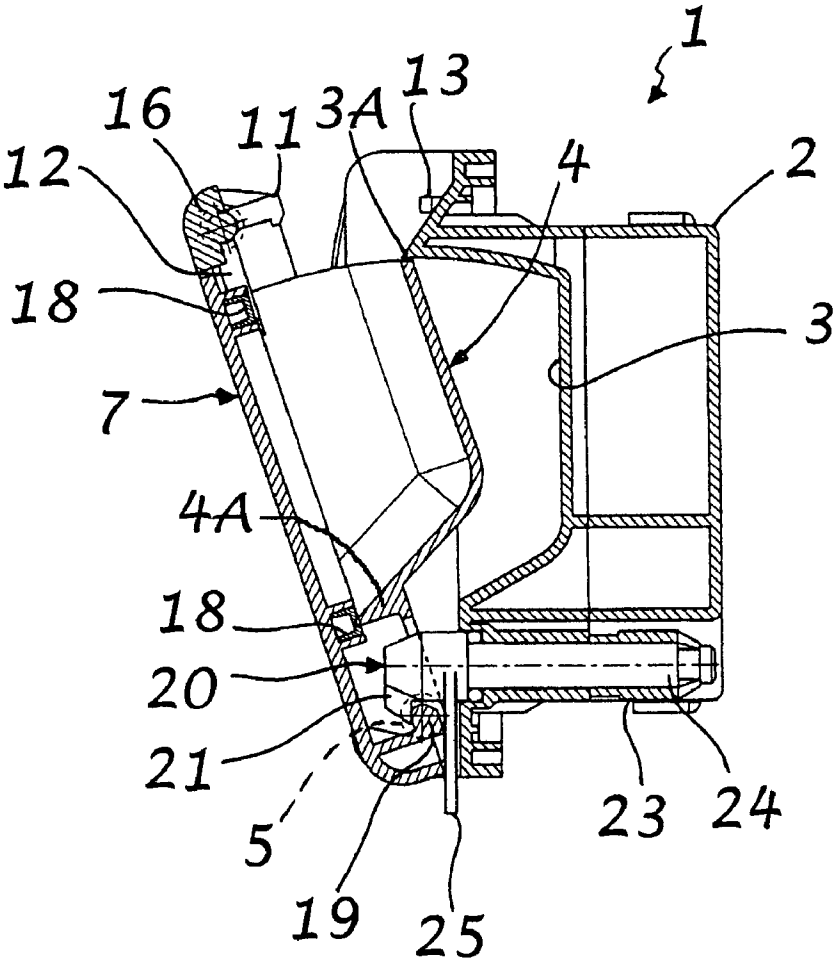
FIG. 8 is a cross section similar to that of FIG. 7, but with the dispenser in its second operating condition, as shown in FIGS. 2 and 3.

Following upon manual release, the assembly 4, 7 moves angularly into the position illustrated in FIGS. 2, 3 and 8. The said movement may come about automatically if a spring similar to the one designated previously by 9 is provided (FIGS. 3 and 5) between the element 4 and the body 2 in a position corresponding to at least one of the pins 5.

The above angular movement is obviously enabled by the fact that the element 4 is hinged in its bottom area by means of the pins 5 to the body 2. As mentioned previously, in this step, the rounded surface of the tooth 19 of the lid 7 is of considerable importance since, during angular movement, it remains in contact with, and slides over, the portion 21 of the lever 20. The aforesaid rounded shape makes it possible to maintain the position of the lid 7 with respect to the element 4 constant, with evident advantages in terms of precision and regularity of displacement. In this connection, it should moreover be considered that the rounded portion of the tooth 19 is aligned with the pins 5. In the position shown in FIGS. 2, 3 and 8, the user can charge the desired dose of detergent into the compartment 6, this operation being facilitated by the presence of the chute portion 3A. Note that, in this charging step, the space provided for receiving the detergent is delimited by the compartment 6 of the element 4 and by the lid 7.

Once detergent has been charged, the lid 7 is pushed towards the body 2 so as to bring the tooth of the arm 11 of the shaft 10 back into a position of engagement in the respective seat 13 (see again FIG. 6), the said engagement being achieved substantially by movements of the various components which are opposite to the movements previously described with reference to the step of manual release.

Now the user can close the door of the dish-washer and start the washing cycle according to known procedure. In the initial steps of said cycle, i.e., prior to delivery of the detergent, part of the water that splashes inside the washing chamber of the dish-washer can penetrate inside the compartment 6 so as to bring about partial dissolution of the detergent through the gap, visible in FIG. 7, between the end of the chute portion 3A and the gasket 18. In the case of the variant illustrated in FIG. 10, the inside of the compartment 6 will, instead, be isolated from any splashing of water that might possibly strike the dispenser 1, as a result of the action of sealing exerted by the gasket 18 in combination with the lip 4A and the end of the chute portion 3A.

At the appropriate moment of the washing cycle, the control system of the dish-washer electrically supplies the actuator means aimed at producing angular actuation of the shaft 24 and hence of the lever 20.

Following upon movement of the lever 20, which takes place in the clockwise direction, disengagement is obtained between the engagement portion 21 and the tooth 19 of the lid 7.

As a result of the action of the spring 9 (see FIG. 3 or FIG. 5), the lid 7 is automatically induced to open, with an angular movement about the horizontal axis defined by the tubular seats 8 of the element 4, which are inserted in respective holes present on the two opposite sides of the lid 7. Of course, after release, the lever 20 returns into its original position as a result of the action of the respective elastic means referred to previously.

In this step, as may be seen in FIG. 9, the top part of the assembly 4, 7 remains in a fixed position in that it is anchored to the body 2 by engagement of the tooth provided on the arm 11 in the respective seat 13 (see FIG. 6).

The condition of complete opening of the lid 7 may be seen in FIG. 4.

Opening of the lid 7 enables the detergent to drop inside the washing chamber of the dish-washer. Dropping of the detergent is facilitated by the inclined conformation of the bottom wall of the compartment 6. Complete removal of the detergent from the compartment is then obtained by the jets of liquid coming out of the sprays inside the dish-washer. In the condition where the lid 7 is completely open (see FIG. 4), the said sprays can impinge directly on the compartment 6. The washing cycle then proceeds according to modalities in themselves known.

The dispenser 1 according to the invention can also be advantageously applied to washing machines equipped with a loading door that tips or turns over forwards or can be tipped or turned backwards.

In the case of use on the latter type of machines, the user of the dish-washer is afforded the possibility of carrying out charging of the compartment 6 with detergent according to two different procedures. In fact, in addition to the operating mode described previously, which enables charging of the machine with detergent with the door of the dish-washer half open, the user is in any case guaranteed the possibility of carrying out charging with detergent also in a traditional way, i.e., with the door completely open or with the door horizontal (i.e., the dispenser 1 will be in the position of lie illustrated, for example, in FIG. 4). In this condition, with the door of the dish-washer in the horizontal position, charging of the detergent will be carried out according to known procedures, if need be opening the lid 7 using the arm 25 of the lever 20.

Figure 11:
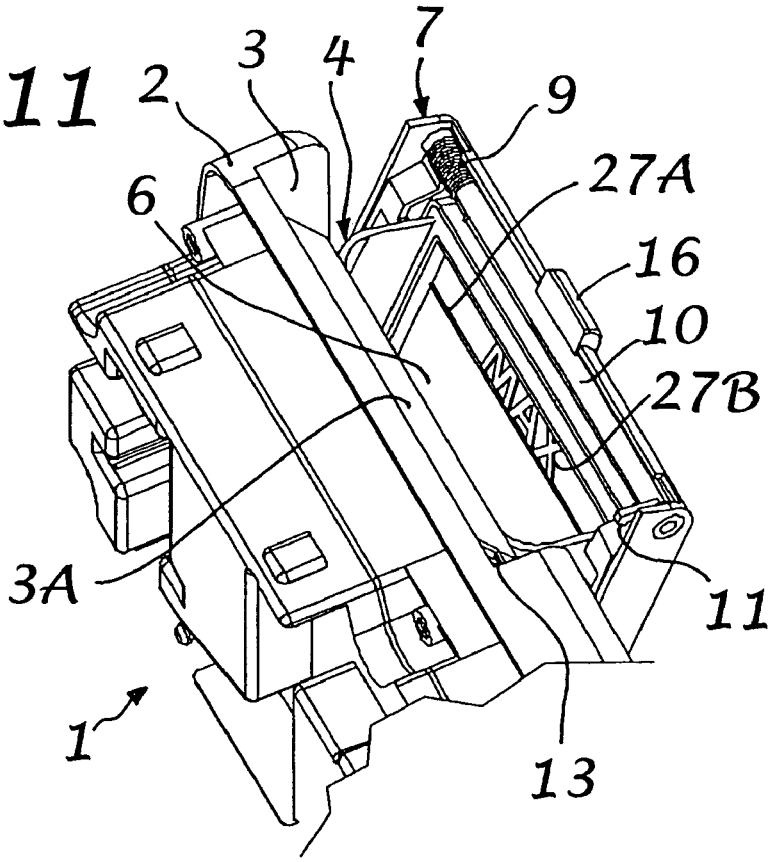
FIG. 11 is a partial perspective view of a dispenser of washing agents made according to a second possible variant of the invention in an operating condition similar to the one illustrated in FIGS. 2 and 3.
Figure 12:
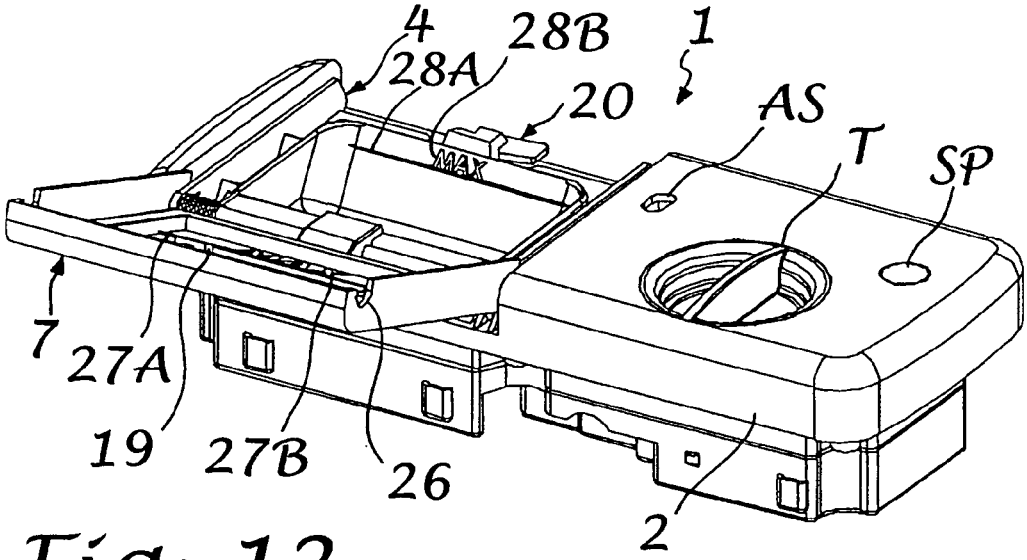
FIG. 12 is a perspective view of the dispenser according to the variant illustrated in FIG. 11, in an operating condition similar to the one illustrated in FIG. 4.

FIGS. 11 and 12 illustrate a preferred embodiment of the invention, according to which the dispenser is provided with indicator means aimed at facilitating proper dosing of the detergent. In these figures, the same reference numbers used in the previous figures are once again used to indicate elements that are technically equivalent to the ones described previously. Note that, in the case illustrated in the said figures, the spring 9 is not housed in a respective tubular seat 8.

FIG. 11 illustrates a situation of charging the detergent similar to the situation illustrated in FIGS. 3 and 8, i.e., with the door of the dish-washer half open or in a prevalently vertical position. In accordance with the variant proposed, on the part of the internal surface of the lid that faces the compartment 6 of the element 4, there appear indications of dosage of detergent, represented in the specific case by a transverse mark or notch 27A indicating the maximum level of detergent, with a respective wording MAX designated by 27B.

FIG. 12 illustrates, instead, a situation of charging with detergent with the door of the dish-washer substantially horizontal, i.e., with a lie of the dispenser 1 similar to the one illustrated in FIG. 4. According to this variant, on the visible surface of the compartment 6 of the element 4, there appear indications of level similar to the ones shown in FIG. 12, i.e., a transverse mark or notch indicating the maximum level of detergent, designated by 28A, and a respective wording MAX, designated by 28B.

As will be appreciated, then, in the embodiments illustrated in FIGS. 11 and 12, there are made available to the user indications aimed at facilitating proper dosage of the detergent both in the condition of vertical charging and in the condition of horizontal charging.

From the foregoing description, as well as from the attached claims, which constitute an integral part thereof, the characteristics of the present invention and its advantages emerge clearly, namely:

- the dispenser 1 can be mounted indifferently on doors that turn over, on sliding doors, or on constantly vertical surfaces, it being possible for charging with detergent to be carried out in any case in a convenient and easy position for the user.
- the items making up the invention are few in number, present a simple structure, and can be easily manufactured by processes of moulding of thermoplastic material.
- the movements involved in charging the machine with a dose of detergent and in obtaining subsequent delivery of the detergent are of an elementary nature.

In addition, it is to be pointed out that the embodiment of the dispenser according to the invention enables the user to:

verify easily the level of dosage of the detergent (an advantage, for example, that is not afforded in the case of DE-A-19843976, where, on account of the small dimensions of the auxiliary lid for charging with detergent, control of the filling level of the respective tray proves problematical);

perform in a simple manner complete filling of the compartment that is designed to contain the detergent (without the typical risks presented by the prior art referred to above, where the detergent tends to come out at the sides and/or from the bottom part of the auxiliary lid, in the area where the latter is hinged to the main lid; and carry out complete filling of the compartment designed for containing the detergent with a liquid washing agent or with tablets of detergent of large size (also this advantage not being possible according to the prior art referred to above).

A further advantage, this time of a manufacturing nature, relates to the fact that the body 2 itself of the dispenser 1 according to the invention can be used also for the purposes of making traditional dispensers, i.e., ones equipped just with a lid hinged only in its top part directly to the body 2. In this case the body 2 will be advantageously equipped with lateral holes, in the top part of the housing 3, in which respective hingepins of the lid can be inserted directly.

In the above use, of course, the space for containing the detergent will be greater than the space available according to the invention, in so far as it is defined directly by the central depression of the housing 3 (in the case of the application of the present invention, as illustrated previously, said central depression is in part occupied by the compartment 6). Furthermore, the sealing system on the lid 7 may be modified if need be. The engagement/release system afforded by the lever 20 and by the corresponding actuation means can be the same as the one described previously.

In a possible variant embodiment of the invention, the articulation element 4 may be in the form of a simple fork or U-shaped element, i.e., without the full central part, in which, in the attached figures, the compartment 6 is defined. In accordance with the said variant embodiment, the space for containing the detergent would be therefore formed directly by the central depression of the housing 3.

In this perspective, the element 4 could also be replaced by two parallel arms, articulated in the respective bottom parts to the body 2 by means of pins similar to the ones designated by 5, there being instead articulated, to the top part of said arms, the lid 7, by means of a system of articulation or hinging similar to the one illustrated in FIGS. 2 to 5.

In accordance with a further variant embodiment, the shaft 10 could also constitute the pin for turning of the lid 7 with respect to the intermediate element 4.

Figure 13:
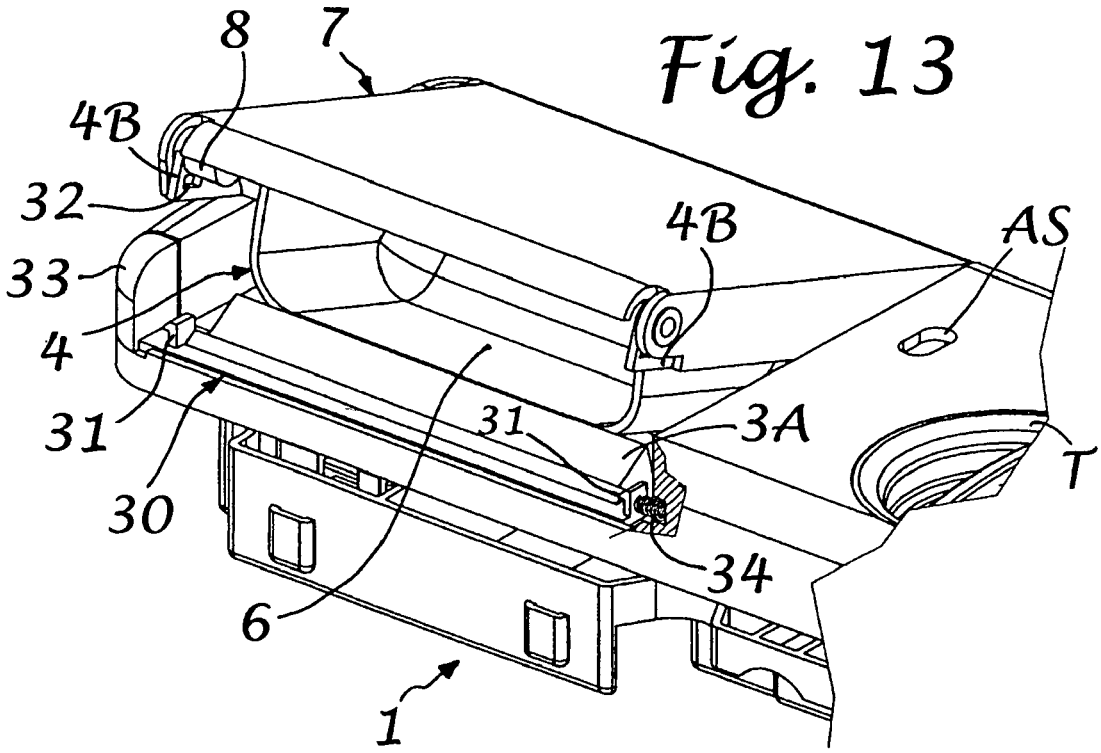
FIG. 13 is a perspective view of a part of the dispenser of washing agents made according to a third possible variant of the present invention.

FIG. 13 illustrates a further possible variant embodiment of the system of engagement/release for the top part of the assembly made up of the element 4 and the lid 7 with respect to the body 2.

In the case of said variant, the shaft 10 and the components associated thereto are no longer envisaged, and nor are the seats 13, 15 and the spring 14 of FIG. 6.

In order to enable manual engagement/release of the assembly 4, 7 in its top part, there is provided, according to the proposed variant, a slide element, i.e., an element that can move linearly, designated as a whole by 30, which is mounted on the body 2 in a position corresponding to the top end of the housing 3 so as to be able to slide in a direction transverse to the housing itself.

The slide element 30 has two engagement teeth, which can engage in respective seats 32, defined in opposite side appendages or flaps 4B of the articulation element 4.

When pressed on one of its side portions, designated by 33, the slide element 30 is able to slide, against the action of a spring 34, in the direction for releasing the teeth 31 from the respective seats 32 and thus obtain the release of the assembly 4, 7 with respect to the body 2. As may be readily understood, engagement is instead obtained by pressing the assembly 4, 7 towards the body 2, so as to produce, via interference of the portions 4B of the element 4 with an inclined top surface of the teeth 31, a lateral displacement of the slide element 30, against the action of the spring 33, said displacement enabling subsequent engagement of the same teeth 31 in the respective seats 32.

In another possible variant (not represented), the dispenser 1 could be provided with end-of-travel means, according to a design in itself known, which operate for limiting the movement of opening of the assembly 4, 7, which comes about for the purpose of vertical charging of the detergent (see, for example, FIGS. 3 and 11), the aim being to prevent the bottom wall of the compartment 6 from exceeding the chute portion 3A, with the consequent risk that some detergent may penetrate or be erroneously poured between the intermediate element 4 and the seat 3 in the body 2.

Figure 14:
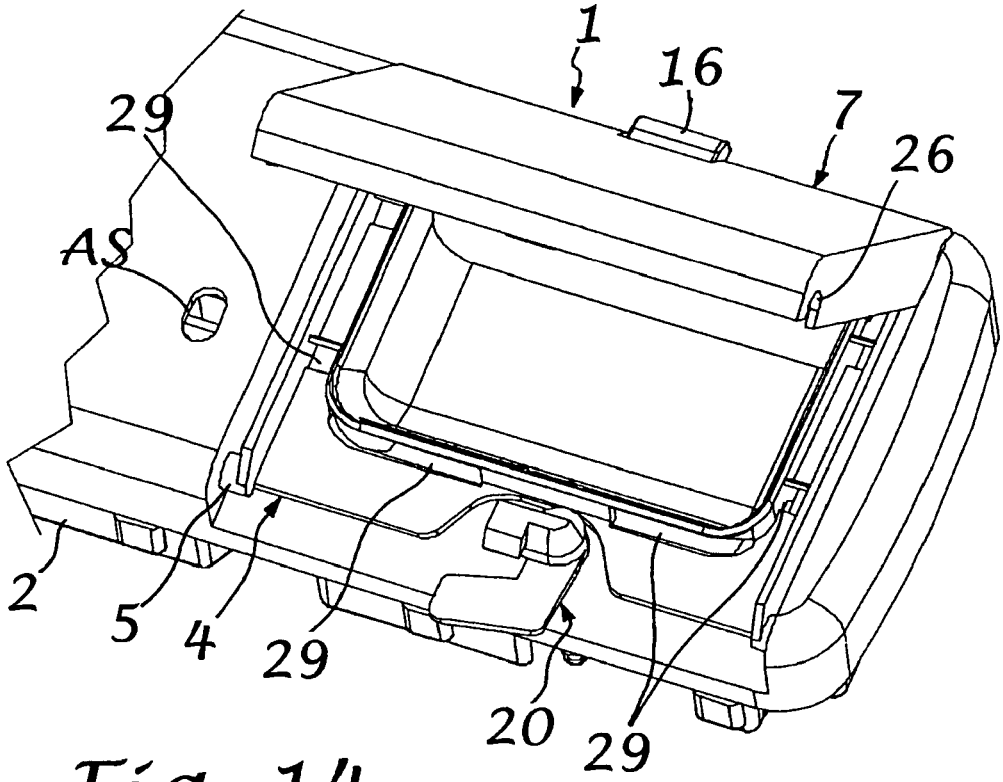
FIG. 14 is a perspective view of a part of the dispenser of washing agents made according to a fourth possible variant of the present invention.

In FIG. 14, in which the same reference numbers are used as in the previous figures, there is illustrated a further possible variant of the invention, according to which the intermediate element 4 is provided with openings 29 along the sides of the lip 4A, the aim being to allow, during washing of the dishes, passage of water also between the intermediate element 4 and/or the compartment 6 and the body 2 so as to favour removal of any possible residue of detergent that might be present therein. Preferably, at least the openings 29 provided along the two opposite sides of the lip 4A are also provided with fins or deflectors to enable better conveying of the flow of water towards the rear part of the compartment 6.

In accordance with a further possible variant of the invention, the intermediate element 4 is laterally coupled to the body 2 so as to be able to perform angular movements about an axis of rotation that is substantially perpendicular to the axis of rotation of the lid 7, the latter being hinged, in its top part, to the same element 4, as described previously.

Figure 15:
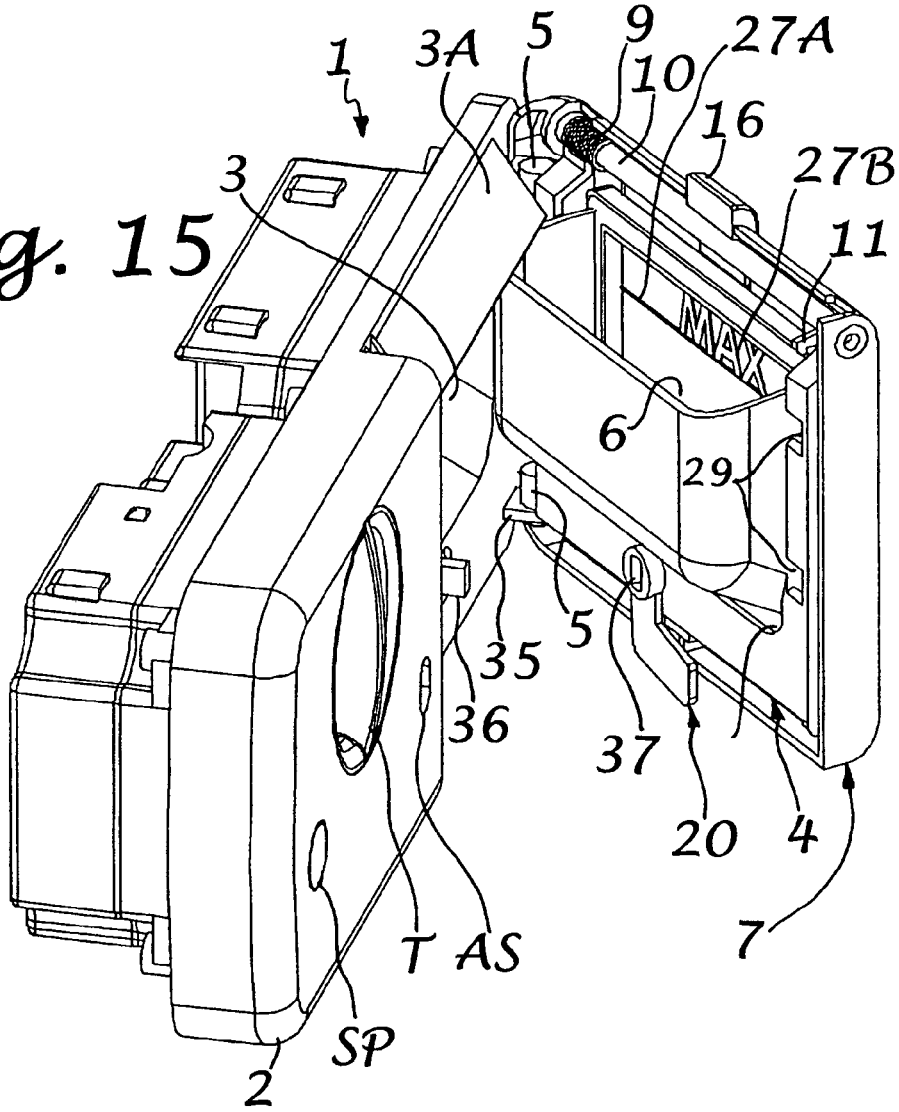
FIG. 15 is a perspective view of a part of the dispenser of washing agents made according to a fifth possible variant of the present invention.

In the case of the above variant, which is illustrated in FIG. 15, in one side of the seat 3, there are provided two brackets, designated by 35, which co-operate with respective cylindrical appendages or pins 5 defined in the homologous side of the intermediate element 4 so that the latter is hinged to the body 2. The lid 7 is, instead, hinged to the element 4 in its top part, as in the case of the embodiments described previously.

According to the above variant, then, vertical charging of the detergent inside the containment space formed by the compartment 6 and by the rear surface of the lid 7 is obtained by moving angularly the assembly 4, 7 according to an axis that is substantially perpendicular to the one illustrated in the embodiment of FIGS. 1 to 9, but with the same advantages in terms of convenience of use for the user.

In the case of the variant of FIG. 15, the bottom-engagement system of the lid 7 is made up of two parts. A first part, carried by the body 2, comprises the transmission element 23 and the shaft 24 (for reference, see FIG. 4 and FIGS. 7 to 9), where the front end of said shaft, which projects in the seat 3, defines a key designated by 36 in FIG. 15.

The second part of the engagement system, which is carried by the intermediate element 4, is similar to the lever designated previously by 20, which here carries an opening at the rear, the said opening being designated by 37 in FIG. 15.

In said opening 37, the key 36 can be fitted when the assembly 4, 7 is brought into the respective closing position. The lever 20 will, of course, be operative for keeping the lid 7 engaged to the element 4 when the assembly 4, 7 is open in the vertical charging position.

In accordance with a further possible variant, the engagement arrangements 9-16 or 30-34 could be replaced by other suitable retention means designed to keep the intermediate element 4 in the closing position with respect to the body 2. The said means could, for instance, be of the friction type and be arranged in a position corresponding to the intermediate elements 4 or the pins 5. In one possible embodiment, the said friction means could be made in the form of disks made both on the body 2 and on the intermediate element 4 and having toothed surfaces which face one another and mesh with one another. The aforesaid disks would be designed to bend as a result of the elasticity of the thermoplastic material of which they are made so as to disengage or unmesh under the manual action of opening and closing and then engage together with one another in the new position since they have a force of mutual engagement such as to maintain the intermediate element 4 in position.

In this connection, it is to be pointed out that the aforesaid friction elements or disks could require a force of engagement that is relatively contained. In fact, if the example of embodiment illustrated in FIG. 7 is considered (where the compartment 6 does not present fluid tightness in its top part), the friction elements do not necessarily have to be such as to compress the gasket.

Of course, the various positions of engagement/release of the intermediate element 4 referred to in the previous embodiments are equivalent to the ones envisaged by the variant that has just been presented by way of example.

The invention claimed is:

1. A dispenser of washing agents for a household washing machine, in particular a dish-washer, said dispenser (1) comprising a body (2);

at least one recess (6) for containing a washing agent, the recess (6) having an overall width, an overall height and a depth when seen from a front of the dispenser (1); and a lid (7) that, in a respective closed position, keeps the recess (6) closed in order to retain the washing agent therein, the lid (7) having an overall width and an overall height when seen from a front of the dispenser (1);

wherein the whole lid (7) can be moved angularly towards the inside of a washing chamber of the machine on which the dispenser (1) is mounted, an angular movement of the whole lid (7) relative to said body (2) taking place about a first axis of rotation (8) between said closed position and a respective delivery position, in which said recess (6) is at least partially open to enable delivery of the washing agent in said chamber;

wherein the dispenser (1) further comprises articulation means (4), which are interconnected between said body (2) and said lid (7) for enabling the whole lid (7) to perform angular movements about a second axis of rotation (5), between said closed position and a respective filling position, in which the whole lid (7) is positioned such that said recess (6) is at least partially open, so as to enable access therein for the purposes of charging said washing agent;

wherein said overall width of the lid (7) is greater than the overall width of the recess (6);

and wherein said articulation means (4) are arranged to be angularly movable relative to said body (2) about said second axis (5) along with said lid (7), to move the whole lid (7) between said closed position and said filling position, whereas when said lid (7) moves between said closed position and said delivery position said articulation means (4) remain stationary relative to said body (2).

2. The dispenser according to claim 1, wherein said lid (7) includes a closing member (7) defining the overall width of said lid, said articulation means (4) have an overall width when seen from a front of the dispenser (1) and the overall width of the lid defined by said closing member (7) is greater than the overall width of the articulation means (4).

3. The dispenser according to claim 2, wherein retention means (19-20, 9-16; 30-34) are provided, which are operative for maintaining the whole lid (7) in said closed position, wherein said retention means (19-20, 9-16; 30-34) comprise first retention means (19, 20), which can be switched between a respective engagement condition and a respective release condition, and vice versa, where:

in said engagement condition, said first retention means (19, 20) are operative for withholding a first end portion of said closing member (7) in the proximity of said body (2); and in said release condition, said first retention means (19, 20) are operative for freeing said closing member (7), the closing member thus being able to perform angular movements with respect to said first axis (8), said first end portion thus being able to move at least in part away from said body (2);

and wherein said first retention means (19-20) can be switched automatically by actuating means (23, 24) associated to said body (2).

4. The dispenser according to claim 3, wherein said retention means (19-20, 9-16; 30-34) comprise second retention means (9-16; 30-34), which can be switched manually between a respective first condition and a respective second condition, where:

in said first condition, said second retention means (9-16; 30-34) are operative for withholding in the proximity of said body (2) one of a second end portion of said closing member (7), said first axis (8) and said articulation means (4); and in said second condition, said second retention means (9-16; 30-34) are operative for enabling said articulation means (4) to move, together with said closing member (7) about said second axis (5), said second end portion being able to move away accordingly at least in part from said body (2).

5. The dispenser according to claim 4, wherein:

in said delivery position, said first retention means (19, 20) are in the respective release condition, and said second retention means (9-16; 30-34) are in the respective first condition;

in said filling position, said first retention means (19, 20) are in the respective engagement condition, and said second retention means (9-16; 30-34) are in the respective second condition; and in said closed position, said first retention means (19, 20) are in the respective engagement condition, and said second retention means (9-16; 30-34) are in the respective first condition.

6. The dispenser according to claim 4, wherein second elastic means are provided, which are operative between said body (2) and said articulation means (4) for moving the articulation means and said second end portion away from said body (2).

7. The dispenser according to claim 4, wherein said second retention means (9-16; 30-34) comprise an element (30) slidably mounted on said body (2) and having at least one respective engagement projection (31), which is able to engage in a respective seat (32) defined in said articulation means (4).

8. The dispenser according to claim 4, wherein said second retention means (19- 20, 9-16; 30-34) comprise friction means.

9. The dispenser according to claim 3, wherein said first retention means (19, 20) comprise an engagement projection (19) fixed to said lid (7) and having a rounded surface, which is able to co-operate with a respective retention element (20), where, during angular movement of said lid (7) about said second axis (5), said rounded surface remains in contact with and slides over said retention element (20) to maintain a position of said lid (7) with respect to said articulation means (4) substantially constant.

10. The dispenser according to claim 3, wherein first elastic means (9) are provided, which are operative between said articulation means (4) and said lid (7) for moving said first end portion away from said body (2).

11. The dispenser according to claim 3, wherein on at least one portion of a surface of said lid (7) there appear indications (27A, 27B) of dosage of the washing agent.

12. The dispenser according to claim 3, wherein at least one first mobile element (20) of said first retention means (19, 20) is associated to said articulation means (4) and at least one second mobile element (24) of said first retention means (20) is associated to said body (2), there being provided between said first mobile element (20) and said second mobile element (24) mutual engagement means (36, 37), which can be decoupled from one another in at least one operating condition of the dispenser (1).

13. The dispenser according to claim 2, further comprising first hinging means (5; 35) between said articulation means (4) and said body (2), wherein said first hinging means comprise at least one pin (5) inserted in a respective passage (35), the pin (5) being defined in said articulation means (4), and the passage (35) being present on said body (2), or vice versa.

14. The dispenser according to claim 13, further comprising second hinging means (8) between said articulation means (4) and said closing member (7), wherein said second hinging means comprise one or more cylindrical elements (8), each inserted in a respective hole, each cylindrical element (8) being defined in said articulation means (4), and the respective hole being present on said lid (7), or vice versa.

15. The dispenser according to claim 14, wherein two of said cylindrical elements (8) are provided, there being inserted in each of them a respective end of a shaft (10), which is able to perform angular movements and which forms part of said second retention means (9-16; 30-34), and wherein the dispenser further comprises:

a first tooth (11), co-operating with a respective engagement seat (13) integral with said body (2);

a projection (12), co-operating with elastic means (14) associated to said articulation means (4);

actuating element (16) being manually operable for producing angular movements of said shaft (10); the first tooth (11), the projection (12) and the actuating element (16) being integral with said shaft (10).

16. The dispenser according to claim 1, wherein said articulation means (4) have an overall height when seen from a front of the dispenser (1), said lid (7) includes a closing member (7) defining the overall height of said lid, and the overall height of the closing member (7) is greater than the overall height of the articulation means (4).

17. The dispenser according to claim 1, wherein said articulation means comprise a movable intermediate component (4) defining at least one rear part of said recess (6), the rear part of the recess (6) being movable relative to said body (2) along with said intermediate component (4) and the whole lid (7), when the whole lid moves between said closed position and said filling position.

18. The dispenser according to claim 17, wherein a seat (3) is defined in a front region of said body (2), within which said at least one rear part of the recess (6) is inserted when said lid (7) is in said closed position and in said delivery position, whereas said at least one rear part of the recess (6) is at least partially extracted from said seat (3) when said lid (7) is in said filling position.

19. The dispenser according to claim 18, wherein a surface of said seat (3) faces said upper opening of the recess (6) when said at least one portion of the recess (6) is inserted within said seat (3).

20. The dispenser according to claim 17, wherein said intermediate component (4) has two parallel upright portions and a wall extending between said upright portions, said wall forming said rear part of the recess (6), said rear part facing a rear face of said lid (7) when said lid is in at least one of said filling position and closed position.

21. The dispenser according to claim 17, wherein on at least one portion of a surface of said intermediate component (4) there appear indications (28A, 28B) of dosage of the washing agent.

22. The dispenser according to claim 1, wherein said articulation means (4) have a front surface facing a rear surface of the lid (7), such that said front surface of said articulation means (4) is hidden by said lid (7) when the lid is in at least one of said closed position and filling position.

23. The dispenser according to claim 1, wherein said recess (6) has a front opening and an upper opening;

the front opening of the recess (6) is closed by said lid (7) when the lid (7) is in said closed position and in said filling position;

the upper opening of the recess (6) is inaccessible when said lid (7) is in said closed position and is accessible when the lid (7) is in said filling position.

24. The dispenser according to claim 1, wherein the recess (6) has a front opening having a width and a height and the width and the eight of the lid (7) are greater than the width and the height of the front opening of the recess (6).

25. The dispenser according to claim 1, wherein the recess (6) has a front opening having a width and the articulation means (4) include two uprights elements extending parallel to each other at a distance which is greater than the width of the front opening of the recess (6).

26. The dispenser according to claim 1, wherein said first axis (8) is substantially perpendicular to said second axis (5).

27. The dispenser according to claim 1, wherein said articulation means include an intermediate component (4) which is hinged at a lower section thereof to said body (2), for allowing said intermediate component (4) to rotate about said second axis, and wherein said lid (7) is hinged at an upper section thereof to said intermediate component (4), for allowing the whole lid (7) to rotate about said first axis.

28. The dispenser according to claim 1, wherein said articulation means (4) are provided, at a front face thereof, with sealing means (4A) co-operating with sealing means (18) provided at a rear face of said lid when said lid is in at least one of said closed position and filing position.

29. The dispenser according to claim 1, wherein said lid (7) is provided, at a rear face thereof, with first sealing means (18)

co-operating with second sealing means (3A) provided at a front face of said body when said lid is in said closed position.

30. The dispenser according to claim 1, wherein said articulation means (4) comprise at least one of a fork-shaped or substantially U-shaped element, two parallel arms, articulated at respective bottom parts to said body (2) and at respective top parts to said lid (7).

31. The dispenser according to claim 1, wherein in said body (2) a chute portion (3A) is defined, which is operative for facilitating charging of the washing agent in said recess (6).

32. The dispenser according to claim 1, wherein said articulation means (4) have one or more openings (29) to enable passage of water towards said body (2) and/or towards a rear part of said articulation means (4).

33. The dispenser according to claim 1, further comprising end-of-travel means, which are operative for limiting angular movement of said lid (7) and/or said articulation means (4).

34. A dispenser of washing agents for a household washing machine, in particular a dish-washer, said dispenser (1) comprising a body (2);

at least one compartment (6) for containing a washing agent;

a lid (7) that, in a respective closed position, keeps the compartment (6) closed in order to retain the washing agent therein;

wherein the lid (7) can be moved angularly towards the inside of a washing chamber of the machine on which the dispenser (1) is mounted, an angular movement of the lid (7) taking place about a first axis of rotation (8) between said closed position and a respective delivery position, in which said compartment (6) is at least partially open so as to enable delivery of the washing agent in said chamber;

the dispenser (1) further comprising articulation means (4) which are interconnected between said body (2) and said lid (7) and are angularly movable about a second axis of rotation (5) along with said lid (7), when the lid moves between said closed position and a respective filling position, in which the lid (7) is positioned such that said compartment (6) is at least partially open, to enable access therein for the purposes of charging said washing agent;

wherein said lid (7) has an overall width, said articulation means (4) have an overall width and the overall width of the lid (7) is greater than the overall width of the articulation means (4);

and wherein said articulation means (4) have a front surface facing a rear surface of said lid (7), such that the front surface of said articulation means (4) is hidden by said lid (7) when the lid is in at least one of said closed position and filling position.

35. A dispenser of washing agents for a household washing machine, in particular a dish-washer, said dispenser (1) comprising a body (2);

at least one compartment (6) for containing a washing agent;

a lid (7) that, in a respective closed position, keeps the compartment (6) closed in order to retain the washing agent therein wherein the lid (7) can be moved angularly towards the inside of a washing chamber of the machine on which the dispenser (1) is mounted, the angular movement of the lid (7) taking place about a first axis of rotation (8) between said closed position and a respective delivery position, in which said compartment (6) is at least partially open so as to enable delivery of the washing agent in said chamber;

the dispenser (1) further comprising articulation means which include an intermediate component (4) defining at least a part of said compartment (6), said intermediate component (4) being interconnected between said body (2) and said lid (7) and operative for enabling the lid (7) to perform angular movements about a second axis of rotation (5), between said closed position and a respective filling position, in which the lid (7) is positioned such that said compartment (6) is at least partially open, to enable access therein for the purposes of charging said washing agent;

wherein the compartment (6) is movable relative to said body (2) along with said intermediate component (4) and said lid (7), when the lid moves between said closed position and said filling position, whereas said compartment (6) and said intermediate component (4) remain stationary when said lid (7) moves from said closed position to said delivery position.

36. A dispenser of washing agents for a household washing machine, in particular a dish-washer, said dispenser (1) comprising a body (2);

at least one compartment (6) for containing a washing agent;

a lid (7) that, in a respective closed position, keeps the compartment (6) closed in order to retain the washing agent therein;

wherein the lid (7) can be moved angularly towards the inside of a washing chamber of the machine on which the dispenser (1) is mounted, the angular movement of the lid (7) taking place about a first axis of rotation (8) between said closed position and a respective delivery position, in which said compartment (6) is at least partially open so as to enable delivery of the washing agent in said chamber;

the dispenser (1) further comprising articulation means (4) which are interconnected between said body (2) and said lid (7) and are operative for enabling the lid (7) to perform angular movements about a second axis of rotation (5) between said closed position and a respective filling position, in which the lid (7) is positioned such that said compartment (6) is at least partially open, to enable access therein for the purposes of charging said washing agent;

wherein said articulation means comprise a movable intermediate component (4) forming at least a rear portion of said compartment (6), the compartment (6) being movable along with said intermediate component (4) and said lid (7) when the lid (7) moves between said closed position and said filling position;

wherein a seat (3) is defined in a front region of said body (2), within which said rear portion of said compartment (6) is inserted when said lid (7) is in said closed position, the compartment (6) being at least partially extracted from said seat (3) when said lid (7) is in said filling position;

and wherein said second axis (5) is substantially perpendicular to said first axis (8).

* * * * *